US005512063A

United States Patent [19]

Kruse

[11] Patent Number: 5,512,063

[45] Date of Patent: Apr. 30, 1996

[54] USE OF NOVOLAK DERIVATIVES IN THE DYEING OF POLYESTER-CELLULOSE BLEND FABRICS AND PROCESSES FOR THE CONTINUOUS DYEING OF SUCH BLEND FABRICS

[75] Inventor: Hubert Kruse, Königstein, Germany

[73] Assignee: Hoechst Mitsubishi Kasei Co, Germany

[21] Appl. No.: 307,161

[22] Filed: Sep. 16, 1994

[30] Foreign Application Priority Data

Sep. 25, 1993 [DE] Germany ..... 43 32 756.7

[51] Int. Cl.[6] ..... D06P 1/613; D06P 3/85; D06P 3/87; D06P 3/54

[52] U.S. Cl. ..... 8/532; 8/552; 8/560; 8/576; 8/588

[58] Field of Search ..... 8/532, 552, 560, 8/576, 588

[56] References Cited

U.S. PATENT DOCUMENTS 3,993,438 11/1976 Fishwick et al. ..... 8/532
4,403,077 9/1983 Uhrig et al. ..... 525/502

*Primary Examiner*—Margaret Einsmann
*Attorney, Agent, or Firm*—Connolly & Hutz

[57] ABSTRACT

The present invention relates to the use of phenol- and naphthol-novolak alkoxylate mixed esters which as dyeing auxiliaries in the dyeing of polyester-cellulose blend fabrics prevent soiling of the cellulose portion by the disperse dyestuff and to processes for the continuous dyeing of such blend fabrics using phenol- and naphthol-novolak alkoxylate mixed esters.

19 Claims, No Drawings

USE OF NOVOLAK DERIVATIVES IN THE DYEING OF POLYESTER-CELLULOSE BLEND FABRICS AND PROCESSES FOR THE CONTINUOUS DYEING OF SUCH BLEND FABRICS

The present invention relates to the use of novolak derivatives in the dyeing and printing of polyester-cellulose blend fabrics and processes for the continuous dyeing of such blend fabrics in which such novolak derivatives are present in the padding liquors.

When dyeing and printing polyester-cellulose blend fabrics, the polyester portion is usually dyed or printed with disperse dyestuffs and the cellulose portion with reactive, direct, azoic, leuco vat ester, vat, sulphur vat or sulphur dyestuffs (see, for example, Ullmanns Encyklopädie der technischen Chemie, 4th edition, Volume 22, p. 635 ff.).

The problems encountered in this type of process are due to the portion of disperse dyestuff which during dyeing of the polyester portion is not completely transferred to the polyester but remains on the cellulose fibre, soiling it and adversely affecting the brilliance of the dyeing and its fastness properties. The dyestuff remaining there has a different, duller shade than that dissolved in the polyester fibre. This has a negative effect in particular in the case of light-coloured or brilliant dyeings. Its insufficient affinity for the cellulose fibre also diminishes the wet, rub and light fastness properties of the dyeing. This becomes noticeable, for example, in subsequent washing processes, for example in the household wash of the consumer, in that the disperse dyestuff bleeds out constantly and stains differently coloured or, worse, white adjacent fabric. This is a particular problem with deep dyeings which are produced by using excess dyestuff and with dyeings in which the cellulose portion should remain undyed or with prints in which printed areas of different colour or else printed and unprinted areas are present.

A further difficulty when dyeing or printing such blend materials is due to the dispersing agents which are used to prepare the disperse dyestuffs or the dyestuff preparations which inter alia contain disperse dyestuffs. Depending on their method of preparation, these preferably anionic dispersing agents are light brown to black products showing affinity for cellulose and can be easily deposited there and once again leading to dulling, in particular in the case of light-coloured and brilliant dyeings.

This problem is in general counteracted by additional washing of the dyeing in which the soiling particles are removed from the fabric. This washing (clearing) process is time-consuming and cost-intensive. Since the additional washing of the dyeing is carried out at temperatures near the dyeing temperature, any disperse dyestuff having entered the washing liquor may lead to irreversible soiling of the polyester portion. If the clearing is carried out reductively or oxidatively or if dyeing of the cellulose portion is carried out in a reductive medium, the soiling disperse dyestuff is destroyed, which may lead to the formation of cleavage products which in turn can result in soiling.

To avoid these difficulties, the use of ionic or else non-ionic polymer auxiliaries which are used during dyeing or else during the additional washing has been proposed in the patent literature; cf., for example, in DE-A 3,446,922, DE-C 3,414,306, JP-A 47/39,309, JP-A 49/117,782, JP-A 49/117,783 or JP-A 51/119,886.

WO-A 90/09478 describes the use of non-ionic auxiliaries which are effective in significantly reducing cotton soiling. However, these auxiliaries also have a retarding effect on the dyestuff, i.e. they retard or impair its exhaustion onto the polyester portion of the blend fabric. In addition, these auxiliaries have a cloud point in aqueous solution, as a result of which heating of the aqueous dyeing liquors containing these auxiliaries causes some of the dyestuff contained therein to precipitate. This leads to unlevel dyeings.

The possible use as dyeing auxiliary has also been mentioned for the novolak derivatives of EP-B 65,751. However, all that is mentioned of these compounds is that they readily disperse the dyestuff during dyeing of polyester or polyester blend fabrics and thus enable level dyeings to be produced. However, there is no mention of the extent to which these novolak derivatives affect the behaviour of the natural fibre portion in blend fabrics during the dyeing process. This portion should ideally remain unaffected, i.e. unsoiled.

Surprisingly, it has now been found that soiling of the cellulose portion by disperse dyestuffs during dyeing or printing of polyester-cellulose blend fabrics can be prevented or else suppressed to a large extent and that moreover the abovementioned disadvantages associated with the use of the auxiliaries of WO-A 90/09478 do not occur if the dyebaths, padding liquors or printing pastes used for dyeing or printing blend fabrics contain one or more specific novolak alkoxylate mixed esters.

Accordingly, the present invention relates to the use of compounds of the general formula I

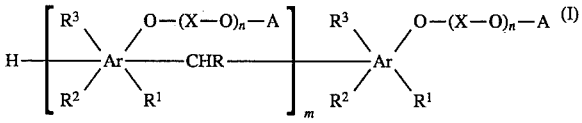

(I)

in which

Ar represents radicals derived from benzene and/or naphthalene, the radicals X represent ethylene groups and/or methylethylene groups, a portion of the radicals A represents benzoyl and/or naphthoyl, a portion of the radicals A represents —CO—CH=CH—$CO_2M$ and/or —CO—$CH_2$—CH($SO_3M$)—$CO_2M$, the radicals M, independently of one another, representing hydrogen and/or metal equivalents and/or substituted or unsubstituted ammonium groups, and any remaining radicals A represent hydrogen, $R^1$ $R^2$ and $R^3$ independently of one another, represent hydrogen or alkyl having 1 to 14 C atoms, the radicals R represent hydrogen and/or alkyl having 1 to 9 C atoms, m is an integer from 2 to 12, and each n represents an integer from 1 to 150 identical to or different from that of the others, as auxiliaries in the dyeing and printing of polyester-cellulose blend fabrics for preventing soiling of the cellulose portion by the disperse dyestuff.

Accordingly, the compounds of the general formula I used according to the invention are multinuclear novolak derivatives whose basic structures are obtained, as is known, by condensation of alkylphenols and/or alkylnaphthols with alkanals. If for a compound of the general formula I the numerical value of m is given, which describes the size of the basic structure, this number is to be understood as a statistical mean of this condensation product. The condensation reaction can take place at different positions of the alkylphenols or -naphthols which is why the position of the free valencies on the radicals pepresenting Ar and derived from benzene or naphthalene is as desired and can vary.

Alkoxylation with ethylene oxide or propylene oxide or mixtures thereof, which takes place during derivatization of the novolak basic structures, leads to products in which the length of the polyalkylene oxide chains can even vary within a molecule from ring to ring, so that n is also to be understood as a statistical mean. The terminal hydroxyl groups of the alkoxylation products can partly be present in the compounds of the general formula I in free form. At least some of them are acylated, the acyl groups being partly benzoyl and/or naphthoyl groups and partly derived from maleic acid and/or sulphosuccinic acid and the relative amounts of benzoyl and naphthoyl groups with respect to one another and those of the groups derived from maleic acid and sulphosuccinic acid with respect to one another and the ratio of the benzoyl and/or naphthoyl groups to the groups derived from maleic acid and/or sulphosuccinic acid being variable within wide limits. This is also true of the portion of carboxylic acid and sulphonic acid groups which have been converted into metal salts and/or ammonium salts. Not only the acyl groups but also the neutralized acid functions in turn form a random distribution.

Suitable metals into whose salts the carboxylic acid and/or sulphonic acid functions may have been converted completely or in part are in particular the alkali metals and alkaline earth metals. Examples of these are lithium, sodium, potassium, magnesium or calcium. If the carboxylic acid and/or sulphonic acid functions have been converted completely or in part into substituted or unsubstituted ammonium salts, the unsubstituted ammonium ion or ammonium ion which may be substituted by one, two, three or four identical or different, straight-chain or branched alkyl radicals having 1 to 12 C atoms which in turn may also be substituted by a hydroxyl group may, for example, be present therein. Ammonium ions containing one or more identical or different polyalkylene oxide chains, such as obtained by alkoxylation of ammonia or mono- or dialkylamines having 1 to 12 C atoms in the alkyl radicals with ethylene oxide and/or propylene oxide, may also be present. Ammonium ions which may be present in compounds of the general formula I can be derived, for example, from the following amines as such or from the alkoxylation products obtainable therefrom by reaction with 1 to 150 mol of ethylene oxide and/or propylene oxide per mole of amine: methylamine, ethylamine, n-propylamine, i-propylamine, n-butylamine, i-butylamine, mono-, di- and triethanolamine, mono-, di- and tri-n- and -i-propanolamine, mono-, di- and tri-n- and -i-butanolamine. Furthermore, the ammonium ion may be derived from di- or polyamines, such as, for example, ethylenediamine, diethylenetriamine, triethylenetetramine or propylenediamine.

Examples of alkyl groups $R^1$, $R^2$ and $R^3$ are methyl, ethyl, propyl, butyl, hexyl, octyl, nonyl, decyl, dodecyl and tetradecyl groups, it being possible for these groups, if containing more than two C atoms, to be present in the form of any desired isomers. As long as the groups mentioned do not contain more than nine C atoms, they are also examples of alkyl radical R.

Ar preferably represents radicals derived from benzene. Preferably, the terminal hydroxyl groups of the polyalkylene oxide chains are for the main part completely acylated by benzoyl and/or naphthoyl groups and acyl groups derived from maleic acid and/or sulphosuccinic acid. M preferably represents hydrogen and/or alkali metals and/or alkaline earth metal equivalents and/or ammonium groups, which may contain alkyl radicals having 1 to 4 C atoms and/or hydroxyalkyl radicals having 1 to 4 C atoms, and/or ammonium groups obtained by an addition reaction of 1 to 150, preferably 5 to 30, ethylene oxide and/or propylene oxide units with ammonia or alkylamines having 1 to 4 C atoms. Particularly preferably, the carboxylic acid and sulphonic acid functions in the radicals derived from maleic acid and sulphosuccinic acid are for the most part completely neutralized- Very particularly preferably, M represents sodium. Preferably one, particularly preferably two, of the three radicals $R^1$, $R^2$, $R^3$ represent hydrogen. $R^1$, $R^2$, $R^3$ as alkyl are preferably alkyl radicals having 1 to 12 C atoms, those having 1 to 9 C atoms being particularly preferred. R preferably represents hydrogen. R as alkyl is preferably an alkyl radical having 1 to 4 C atoms. m is preferably an integer from 4 to 10, particularly preferably from 4 to 8. n is preferably an integer from 2 to 20, particularly preferably an integer from 8 to 20.

Preferably used compounds of the general formula I are those in which $R^1$ represents hydrogen, $R^2$ and $R^3$ independently of one another, represent hydrogen or alkyl having 1 to 12 C atoms, the radicals R represent hydrogen and/or alkyl having 1 to 4 C atoms, m is an integer from 4 to 10, each n is an integer from 2 to 20 identical to or different from that of the others, and M represents hydrogen and/or alkali metals and/or alkaline earth metal equivalents and/or ammonium groups, which may contain alkyl radicals having 1 to 4 C atoms and/or hydroxy alkyl radicals having 1 to 4 C atoms, and/or ammonium groups obtained by an addition reaction of 1 to 150, preferably 5 to 30, ethylene oxide and/or propylene oxide units with ammonia or alkylamines having 1 to 4 C atoms.

Particularly preferably used compounds of the general formula I are those in which Ar represents radicals derived from benzene, $R^1$ and $R^2$ represent hydrogen, $R^3$ represents alkyl having 1 to 9 C atoms, R represents hydrogen, m is an integer from 4 to 8, each n is an integer from 8 to 20 identical to or different from that of the others, and M represents sodium.

The novolak alkoxylated mixed esters employed, i.e. the compounds of the general formula I, and their preparation are described in EP-B 65,751 and its eqivalent, U.S. Pat. No. 4,403,077, which is incorporated herein by reference.

To achieve the effect according to the invention, the compounds of the general formula I can be applied to the fabric by means of a separate liquor or in a separate bath, but preferably they are present in one of the padding liquors or baths which are used anyway in the dyeing process. Particularly preferably, they are present in pad-dyeing liquors, dyebaths or printing pastes. The compounds of the general formula I can be added to the baths, liquors and pastes in pure form, as a solution, in particular in the form of the easily handleable aqueous solution, or in previously prepared mixtures with other substances used in the dyeing process. In the preferred embodiment, in which the compounds of the general formula I are present in pad dyeing liquors, dyebaths or printing pastes, they are preferably already present in the dyestuff preparations from which the dyebaths, pad-dyeing liquors and printing pastes are prepared, that is, they are incorporated therein by means of the preparations. However, if desired, in addition to the amount incorporated in this manner, a further portion of the compound of the general formula I can be added, for example, in the form of an aqueous solution.

If the compounds of the general formula I are incorporated in the liquors, baths and pastes by means of the dyestuff preparations, this is preferably done by means of the disperse dyestuff preparations intended for dyeing the polyester portion, Preference is given to liquid preparations, although pulverulent preparations prepared, for example, by spray-drying may also be used.

The dyestuff preparations can contain one or more disperse dyestuffs. However, in addition to the disperse dyestuff(s), they can additionally contain one or more further dyestuffs for dyeing the cellulose portion of the blend fabric. In the latter case, the disperse dyestuffs in the dyestuff preparations can then be combined, for example, with reactive, sulphur or vat dyestuffs.

The dyestuff preparations mentioned contain the compounds of the general formula I in general in amounts of 0.1 to 30% by weight, preferably 0.5 to 20, particularly preferably 1 to 10, % by weight. The disperse dyestuff content in these preparations is in general between 10 and 60% by weight, preferably between 15 and 45% by weight. The dyestuff preparations can be prepared by conjoint milling of the dyestuff(s) in the presence of one or more compounds of the general formula I and, if desired, one or more dispersing agents and/or one or more emulsifiers and, if desired, in the presence of further auxiliaries in suitable mills. Examples of suitable mills are ball or sand mills. The milling process is carried out at 0° to 90° C. preferably at 20° to 70° C.

The compounds of the general formula I can also be added to the liquid dyestuff preparations after milling, provided they are thoroughly mixed therewith by stirring.

Examples of suitable dispersing agents are anionic or non-ionic dispersing agents which may also be used together. Examples of anionic dispersing agents are salts of condensation products obtained from aromatic sulphonic acids and formaldehyde, in particular condensation products obtained from alkylnaphthalenesulphonic acids and formaldehyde, condensation products obtained from substituted or unsubstituted phenol and formaldehyde and sodium bisulphite, alkali metal salts of condensation products obtained from substituted or unsubstituted phenol, naphthalene- or naphtholsulphonic acids, formaldehyde and sodium bisulphite, alkali metal salts of condensation products obtained from substituted or unsubstituted phenolsulphonic acids, formaldehyde and urea, and alkali metal salts of lignosulphonic acids, alkyl sulphonates or alkylaryl sulphonates and alkylaryl polyglycol ether sulphates. Examples of non-ionic dispersing agents or emulsifiers are reaction products of alkylene oxides, such as, for example, ethylene oxide or propylene oxide, with alkylatable compounds, such as, for example, fatty alcohols, fatty amines, fatty acids, phenols, alkylphenols, arylalkylphenols, arylalkylarylphenols and carboxamides, such as, for example, addition products of 5 to 10 ethylene oxide units with $C_8$–$C_{10}$-alkylphenols.

The dispersing agents mentioned are in general present in the liquid dyestuff preparations in amounts of 10 to 40% by weight, preferably 15 to 30% by weight.

The dyestuff preparations can also contain further auxiliaries, for example those acting as oxidizing agents, such as, for example, sodium m-nitrobenzenesulphonate, or fungitides, such as, for example, sodium o-phenylphenoxide and sodium pentachlorophenoxide. The dyestuff preparations in general contain the auxiliaries mentioned in amounts of 0 to 5% by weight, preferably 0 to 2% by weight.

The amounts of the compounds of the general formula I employed in the use according to the invention and present, for example, in the dyebaths, pad-dyeing liquors or printing pastes naturally depend on the tendency to soiling of the disperse dyestuff preparations used, on the dyestuff content in the dyebath, in the dyeing liquor or the printing paste, on the liquor ratio and on the squeeze-off effect and on the cellulose content in the blend fabric. If disperse dyestuff preparations composed of strongly soiling dyestuffs and furthermore strongly soiling dispersing agents are used, if large amounts of dyestuff are used, if the liquor pickup is high and if the cellulose content of the blend fabric increases while the amount used of the disperse dyestuff remains the same, larger amounts of the compounds of the general formula I must be used.

As a rule, the amounts of compounds of the general formula I present in the pad-dyeing liquors vary between 0.1 and 50 g/l, preferably between 1 and 20 g/l. Particularly preferably, 1 to 10 g/l are used. If the compounds of the general formula I are present in chemical padding liquors, the amounts in general vary within the same limits as in the case of the pad-dyeing liquors. If the disperse dyestuffs used are easily destroyed by the reducing agents or the alkali of the chemical padding liquor and the cleavage products display a low or else a high tendency to soiling, the amounts of the compounds of the general formula I can be changed accordingly. The amount of the compounds of the general formula I when used according to the invention in dyebaths is in general based on the amount of pure dyestuff and is usually 1 to 1000, preferably 10 to 500, particularly preferably 10 to 100, % by weight, relative to the amount of dyestuff used.

It is thus in principle possible to apply the dyestuffs for the polyester portion and the cellulose portion jointly or separately to the fabric, i.e. to treat the fabric with one or more dyebaths, padding liquors or printing pastes containing these dyestuffs and then to fix the dyestuffs on or in the fibres by one or more subsequent steps. The polyester portion of the polyester/cellulose blend fabric can be dyed with disperse dyestuffs by the exhaust method, for example under HT conditions or at the boiling temperature, and also with the addition of carriers. Polyester dyeing with disperse dyestuffs can also be carried out by the thermosol method, which is a continuous dyeing process in which the dyestuff is applied to the fabric in dilute form as a padding liquor, the padding liquor is squeezed off to a certain percentage, the padding liquor remaining on the fabric is pre-dried, and the dyestuff is finally fixed in the fibre by applying heat for a short period of time. Furthermore, the polyester portion can be dyed by applying disperse dyestuffs incorporated in printing pastes, followed by dry heat setting.

The cellulose portion can be dyed analogously, i.e. by the exhaust or by a continuous method or by printing. The dyestuffs used can be one or more representatives, for example, from the groups of reactive, direct, azoic, vat, leuco vat ester, sulphur vat or sulphur dyestuffs. For fixation, for example, chemicals such as alkalizing or reducing agents can then be applied to the fabric by means of separate padding liquors. The alkali fixes the reactive dyestuffs on the cellulose fibre by a chemical reaction, while the reducing agent is capable of converting vat or sulphur vat dyestuffs into a form having affinity for cellulose.

Dyeing of the blend fabric is preferably carried out by a continuous process.

If the various types of fabric are dyed in succession, first the polyester portion and then the cellulose portion can be dyed, although it is also possible to do it the other way around and first to dye the cellulose and then the polyester portion. Preferably, the polyester portion of the blend fabric is dyed first. Detailed procedures of single- and two-bath and single and two-step dyeing methods can be found, for example, in Melliand Textilberichte 61, 261 (1980) and 64, 290, 357 (1983), Textilpraxis international 39 (1984) and 40 (1985) and Chemiefasern/Textilindustrie 1974, 756 and 1977, 562.

Advantageously, in the preferred type of application of the compounds of the general formula I in which the polyester portion of the blend fabric is dyed first, it is in general not necessary to perform a separate washing process before dyeing the cellulose portion. Accordingly, in a particularly preferred embodiment, the blend fabric is not subjected to intermediate clearing after fixation of the disperse dyestuff on the polyester portion.

The use according to the invention of the compounds of the general formula I result in particular advantages if the cellulose portion of the blend fabric is dyed with reactive, sulphur or vat dyestuffs. Preferably, it is dyed with reactive dyestuffs, particularly preferably with reactive dyestuffs carrying one or more vinylsulphonyl and/or sulphatoethylsulphonyl radicals. Accordingly, a very particularly preferred procedure is first to dye the polyester portion of the blend fabric and then to dye the cellulose portion with reactive dyestuffs carrying one or more vinylsulphonyl and/or sulphatoethylsulphonyl radicals. Moreover, it is preferred not to subject the blend fabric to intermediate clearing after fixation of disperse dyestuffs on the polyester portion. In this procedure, prior to dyeing the cellulose portion with the reactive dyestuffs carrying one or more vinylsulphonyl and/or sulphatoethylsulphonyl radicals, the fabric is treated with a chemical bath without a separate washing process being carried out after fixation of the disperse dyestuff(s). In this chemical bath, the salt and the base required for the subsequent dyeing of the cellulose portion with the reactive dyestuff are applied to the fabric. This is followed, in this case too, by squeezing off and fixation of the reactive dyestuff by application of heat, in particular by exposure to steam. Finally, the dyed blend fabric is soaped, washed and dried.

The blend fabrics to be dyed by the process according to the invention in general have a polyester portion of 10 to 90%. The polyester portion is preferably 30 to 70%. The cellulose portion of the blend fabric is preferably cotton.

The use of the compounds of the general formula I as auxiliaries for preventing soiling of the cellulose portion when dyeing the polyester-cellulose blend fabric by the continuous method is associated with particular advantages. The compounds of the general formula I have previously not been used for dyeing by this method. Accordingly, the present invention also comprises processes for the continuous dyeing of polyester-cellulose blend fabrics, characterized in that the padding liquors contain one or more compounds of the general formula I

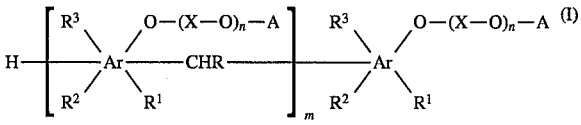

(I)

in which

Ar represents radicals derived from benzene and/or naphthalene, the radicals X represent ethylene groups and/or methylethylene groups, a portion of the radicals A represents benzoyl and/or naphthoyl, a portion of the radicals A represents —CO—CB=CH—$CO_M$ and/or —CO—$CH_2$—$CHSO_3M$)—$CO_M$, the radicals M, independently of one another, represent hydrogen and/or metal equivalents and/or substituted or unsubstituted ammonium groups, and any remaining radicals A may represent hydrogen, $R^1$ $R^2$ and $R^3$ independently of one another, represent hydrogen or alkyl having 1 to 14 C atoms, the radicals R represent hydrogen and/or alkyl having 1 to 9 C atoms, m is an integer from 2 to 12, and each n represents an integer from 1 to 150 identical to or different from that of the others.

The examples and preferred meanings of the radicals in the general formula I already given above also apply to the use of compounds in the process according to the invention. Preferably used compounds of the general formula I are those in which $R^1$ represents hydrogen, $R^2$ and $R^3$ independently of one another, represent hydrogen or alkyl having 1 to 12 C atoms, the radicals R represent hydrogen and/or alkyl having 1 to 4 C atoms, m is an integer from 4 to 10, each n is an integer from 2 to 20 identical to or different from that of the others, and M represents hydrogen and/or alkali metals and/or alkaline earth metal equivalents and/or ammonium groups, which may contain alkyl radicals having 1 to 4 C atoms and/or hydroxy alkyl radicals having 1 to 4 C atoms, and/or ammonium groups obtained by an addition reaction of 1 to 150, preferably 5 to 30, ethylene oxide and/or propylene oxide units with ammonia or alkylamines having 1 to 4 C atoms.

Compounds of the general formula I which are particularly preferably used in the process according to the invention are those in which Ar represents radicals derived from benzene, $R^1$ and $R^2$ represent hydrogen, $R^3$ represents alkyl having 1 to 9 C atoms, R represents hydrogen, m is an integer from 4 to 8, each n is an integer from 8 to 20 identical to or different from that of the others, and M represents sodium.

Incorporation of the compounds of the general formula I can take place in the manner already mentioned, for example by addition of the pure substances or, in particular, of the aqueous solutions to the padding liquors with which the fabric is impregnated. Especially in the continuous dyeing process according to the invention, the preferred embodiment is that in which the compounds of the general formula I are already present in the advantageously liquid dyestuff preparations from which the dyeing liquors are prepared, i.e., in which these compounds are incorporated in the padding liquors by means of the dyestuff preparations. Again, what has been said before also applies to the dyestuff preparations.

In the process according to the invention, the polyester portion of the blend fabric is dyed by the thermosol method. Preferably, the polyester portion of the blend fabric is dyed first, it being particularly preferred not to subject the blend fabric to intermediate clearing, for example via a washing process, after fixation of the disperse dyestuff on the polyester portion. In accordance with the process of the invention, the cellulose portion of the blend fabric is preferably dyed with reactive dyestuffs, particularly preferably with those carrying one or more vinylsulphonyl and/or sulphatoethylsulphonyl radicals.

The cellulose portion of the blend fabric dyed by the process according to the invention is in particular cotton.

The polyester-cellulose blend fabrics to be dyed by the process according to the invention are preferably fabric webs. They preferably have a polyester portion of 30 to 70%. In this preferred embodiment, the entire dyeing process is continuous, i.e., the fabric web is transported continuously through the units of a dyeing range which are coupled to one another and in which the abovementioned individual steps of the entire dyeing process take place in succession.

The invention is illustrated by the examples which follow.

EXAMPLE 1

420 g of a water-containing filter cake of the dyestuff C.I. Disperse Blue 79:1 containing 170 g of pure dyestuff are milled in a sand mill together with 140 g of a ligninsulphonate, 60 g of water and 17 g of auxiliary according to Example 3.5.1. from EP-B 65,751 or U.S. Pat. No. 4,403,077 and having the general formula I in which Ar denotes a radical derived from benzene, X denotes ethylene, A denotes benzoyl and —CO—CH=CH—$CO_2M$ and —CO—$CH_2$—CH($SO_3M$)—$C_2M$, M denotes sodium, $R^1$ denotes an alkyl radical having 9 C atoms, $R^2$ and $R^3$ and R denote hydrogen, n is 15 and m is 6.60 g of the dyestuff thus obtained, after being separated off from the sand, are stirred into a padding liquor together with 15 g of a commercially available antimigrant and 2 g of monosodium phosphate in such a manner that the final volume of the liquor is 11. A 65:35 polyester-cotton blend fabric is impregnated with this padding liquor at 25° C., squeezed off to a wet pickup of about 65%, pre-dried in an infrared drier for 30 seconds, dried at 110° C. for 60 seconds followed by fixation of the disperse dyestuff in the polyester fibre at 210° C. for a period of 90 seconds. The pre-dyed blend fabric is then subjected to the dyeing conditions of a subsequent reactive dyeing but without dyestuff. To this end, the blend fabric is padded at 20° C. with a chemical bath containing 240 g/l of sodium chloride, 15 g/l of sodium carbonate, 11.3 g/l of a 50% strength sodium hydroxide solution and 4 gl of an oxidizing agent based on a benzenesulphonic acid derivative, squeezed off to a wet pickup of 90%, and steamed at 102°–105° C. for 60 seconds. Finally, the blend fabric is rinsed in hot water and dried.

When dyeing is carried out for comparison without adding a compOUnd of the general formula I, the dyeing obtained is significantly duller.

The effect can be shown clearly by dissolving out the cotton portion of the blend fabric with sulphuric acid after dyeing. The dyeing obtained on the remaining polyester portion is much more brilliant with the addition of the compound of the general formula I than without it.

If pure cotton, which naturally cannot be dyed with disperse dyestuffs in this manner, is impregnated as described above with the padding liquor, fixed and subjected to an aftertreatment, the substrate exhibits grey soiling if the dyestuff used does not contain the auxiliary of the general formula I, but is almost white if the auxiliary is added.

EXAMPLE 2

If in Example 1 the 170 g of pure dyestuff, C.I. Disperse Blue 79:1, are replaced by 160 g of pure dyestuff which is a black mixture of C.I. Disperse Blue 79:1, C.I. Disperse Red 167:1 and C.I. Disperse Yellow 114 and pure cotton is, as described in Example 1, impregnated with the padding liquor thus obtained, fixed and after-treated, this cotton remains almost white. If, in contrast, the auxiliary of the general formula I is omitted, the substrate shows substantial red-violet soiling.

EXAMPLE 3

In Example 1, 170 g of pure dyestuff, C.I. Disperse Blue 79:1, are replaced by the same amount of pure dyestuff in the form of C.I. Disperse Blue 60. Moreover, the auxiliary of the general formula I used there is replaced by the auxiliary of the general formula I described in EP-B 65,751, Example 3.1, in which Ar denotes a radical derived from benzene, X denotes ethylene, A denotes benzoyl and —CO—CH=CH—$CO_2M$ and —$COCH_2$—CH($SO_3M$)—$CO_2M$, M denotes sodium, $R^1$ denotes an alkyl radical having 9 C atoms, $R^2$ and $R^3$ and R denote hydrogen, n is 15 and m is 4. If pure cotton is, as described in Example 1, impregnated with the padding liquor thus obtained, fixed and after-treated, the cotton shows less soiling than in the case of a padding liquor not containing the auxiliary of the general formula I.

EXAMPLE 4

0.6 g of the dyestuff preparation of C.I. Disperse Blue 79:1 prepared according to Example 1 is dispersed in 2000 g of water. 4 g of sodium acetate, 2 g of a commercially available dispersing agent based on a condensation product obtained from sodium naphthalenesulphonate and formaldehyde, and 2 g of a condensation product obtained from m-cresol, formaldehyde and sodium sulphite are added to the dispersion, and the resulting mixture is brought to a pH of 4.5 with acetic acid. The dyebath thus obtained is entered with 100 g of a 65:35 polyester-cotton blend fabric, and the fabric is dyed at 130° C. for 45 minutes. After rinsing, the pre-dyed blend fabric is subjected to subsequent reactive dyeing, but without dyestuff, as described in Example 1.

When dyeing is carried out for comparison without adding a compound of the general formula I, the dyeing obtained is significantly duller.

I claim:

1. A process for preventing soiling of the cellulose portion of polyester-cellulose blend fabrics in the dyeing and printing of said fabrics, comprising applying to said fabrics in the dyeing and printing process compounds of the general formula I,

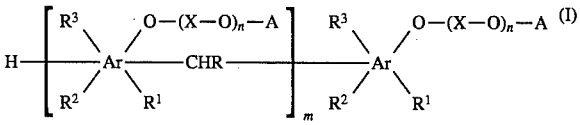

(I)

in which

Ar represents radicals derived from benzene or naphthalene, or a mixure thereof;

the radicals X, which are independent from one another, can be identical or different and represent ethylene groups or methylethylene groups, or a mixture thereof;

the radicals A, which are independent of one another, in part represent benzoyl or naphthoyl, or a mixture thereof, in another part represent —CO—CH=CH—$CO_2M$ or —CO—$CH_2$—CH($SO_3M$)—$CO_2M$, or a mixture thereof, and in any remaining part represent hydrogen, the radicals M, independently of one another, representing hydrogen or metal equivalents or substituted or unsubstituted ammonium groups, or any mixture thereof;

$R^1$, $R^2$ and $R^3$, independently of one another, represent hydrogen or alkyl having 1 to 14 C atoms, or a mixture thereof;

the radicals R represent hydrogen or alkyl having 1 to 9 C atoms, or a mixture thereof;

m is a number from about 2 to about 12; and each n, which can be identical or different from the others, represents a number from 1 to about 150;

the compounds of the general formula I being present in padding liquors or baths or printing pastes which are used anyway in the dyeing and printing process, or being applied to the fabric by means of a separate liquor or in a separate bath.

2. The process according to claim 1, wherein $R^1$ represents hydrogen;

$R^2$ and $R^3$, independently of one another, represent hydrogen or alkyl having 1 to 12 C atoms, or a mixture thereof;

the radicals R represent hydrogen or alkyl having 1 to 4 C atoms, or a mixture thereof; m is a number from about 4 to about 10;

each n, which can be identical or different from the others, represents a number from 2 to about 20; and the radicals M, independently of one another, represent hydrogen or alkali metals or alkaline earth metal equivalents or ammonium groups, which may contain alkyl radicals having 1 to 4 C atoms or hydroxyalkyl radicals having 1 to 4 C atoms or a mixture of such alkyl and hydroxyallcyl radicals, or ammonium groups obtained by an addition reaction of 1 to 150 units of ethylene oxide or propylene oxide or a mixture of ethylene and propylene oxide with ammonia or alkylamines having 1 to 4 C atoms, or any mixture of these denotations.

3. The process as claimed in claim 2, wherein M is an ammonium group obtained by the reaction of 5 to 30 units of ethylene oxide or propylene oxide or a mixture thereof with ammonia or alkylamines having 1 to 4 C atoms.

4. The process according to claim 1, wherein the polyester portion of the blend fabric is dyed or printed first and then the cellulose portion is dyed or printed.

5. The process according to claim 1, wherein the polyester portion of the blend fabric is dyed with disperse dyes.

6. The process according to claim 4, wherein the polyester portion of the blend fabric is dyed with disperse dyes.

7. The process as claimed in claim 6, wherein the polyester portion of the blend fabric is not subjected to intermediate clearing after fixation of the disperse dyestuff on the polyester portion.

8. The process according to claim 1, wherein the cellulose portion of the blend fabric is dyed or printed with reactive dyestuffs.

9. The process as claimed in claim 8, wherein the reactive dyestuffs are those carrying one or more vinylsulphonyl and sulphatoethylsulphonyl radicals or a mixture thereof.

10. The process according to claim 1, wherein the cellulose portion of the blend fabric is cotton.

11. The process according to claim 1, wherein the compounds of the general formula I are present in a dyebath and wherein the dyebath is prepared from a dye preparation in which the compounds of the general formula I are present in amounts from about 0.1 to about 30% by weight.

12. The process according to claim 1, wherein the compounds of the general formula I are present in a dyebath and where the dyebath is prepared from a preparation in which disperse dyestuff present in an amount from about 10 to about 60% by weight.

13. A process for preventing soiling of the cellulose portion of polyester-cellulose blend fabrics in the continuous dyeing of said fabrics, comprising applying to said fabrics in the continuous dyeing process compounds of the general formula I,

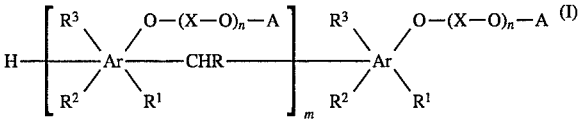

(I)

in which

Ar represents radicals derived from benzene or naphthalene, or a mixture thereof;

the radicals X, which are independent from one another, can be identical or different and represent ethylene groups or methylethylene groups, or a mixture thereof;

the radicals A, which are independent of one another, in part represent benzoyl or naphthoyl, or a mixture thereof, in another part represent —CO—CH=CH—$CO_2M$ or —CO—$CH_2$—CH($SO_3M$)—$CO_2M$, or a mixture thereof, and in any remaining part represent hydrogen, the radicals M, independently of one another, representing hydrogen or metal equivalents or substituted or unsubstituted ammonium groups, or any mixture thereof;

$R^1$, $R^2$ and $R^3$, independently of one another, represent hydrogen or alkyl having 1 to 14 C atoms, or a mixture thereof;

the radials R represent hydrogen or alkyl having 1 to 9 C atoms, or a mixture, thereof;

m is a number from about 2 to about 12; and each n, which can be identical or different from the others, represents a number from 1 to about 150;

the compounds of the general formula I being contained in the padding liquors which are used in the continuous dyeing process.

14. The process according to claim 13, wherein the polyester portion of the blend fabric is dyed with disperse dyes.

15. The process according to claim 13, wherein the polyester portion of the blend fabric is dyed first and then the cellulose portion is dyed.

16. The process according to claim 15, wherein the polyester portion of the blend fabric is dyed with disperse dyes, the blend fabric being not subjected to intermediate clearing after fixation of the disperse dyestuff on the polyester portion.

17. The process according to claim 13, wherein the cellulose portion of the blend fabric is dyed with reactive dyestuffs.

18. The process according to claim 13, wherein fabric webs consisting of polyester-cellulose blend fabrics are dyed, the individual steps of the entire dyeing process taking place in succession in units of a dyeing range which are coupled to one another.

19. The process according to claim 1, wherein

Ar represents radicals derived from benzene, $R^1$ and $R^2$ represent hydrogen, $R^3$ represents alkyl having 1 to 9 C atoms, R represents hydrogen, m is a number from about 4 to about 8, each n independently of one another is a number from about 8 to about 20 and M represents sodium.

* * * * *